US006791267B2

(12) United States Patent
Niimi

(10) Patent No.: US 6,791,267 B2
(45) Date of Patent: Sep. 14, 2004

(54) HIGH PRESSURE DISCHARGE LAMPS, LIGHTING SYSTEMS, HEAD LAMPS FOR AUTOMOBILES AND LIGHT EMITTING VESSELS FOR HIGH PRESSURE DISCHARGE LAMPS

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 100 days.

(21) Appl. No.: 10/251,789

(22) Filed: Sep. 23, 2002

(65) Prior Publication Data

US 2003/0062838 A1 Apr. 3, 2003

(30) Foreign Application Priority Data

Oct. 2, 2001 (JP) ..... PCT/JP01/08674
Jul. 26, 2002 (JP) ..... P2002-218422

(51) Int. Cl.[7] ..... H01J 61/30

(52) U.S. Cl. ..... 313/634; 313/631; 313/623; 313/625; 313/567; 313/573; 220/2.1 R; 362/263; 362/264; 362/265; 362/216; 362/217; 315/246

(58) Field of Search ..... 313/634, 631, 313/621–623, 573, 246; 362/263–265, 216, 217, 223

(56) References Cited

U.S. PATENT DOCUMENTS 5,252,886 A 10/1993 Renardus et al. ..... 313/44
5,438,343 A 8/1995 Khan et al. ..... 313/493
6,586,881 B1 * 7/2003 Miyazawa et al. ..... 313/634
2002/0003670 A1 1/2002 Niimi ..... 313/623
2002/0033671 A1 3/2002 Niimi ..... 313/623

FOREIGN PATENT DOCUMENTS

| | | |
|---|---|---|
| JP | A 5-8684 | 1/1993 |
| JP | A 5-74204 | 3/1993 |
| JP | A 6-20649 | 1/1994 |
| JP | A 10-334852 | 12/1998 |
| JP | A 11-149902 | 6/1999 |
| JP | A 11-329353 | 11/1999 |
| JP | A 2000-268774 | 9/2000 |
| JP | A 2001-76677 | 3/2001 |
| JP | A 2001-256919 | 9/2001 |

* cited by examiner

*Primary Examiner*—Nimeshkumar D. Patel
*Assistant Examiner*—Sikja Roy
(74) *Attorney, Agent, or Firm*—Oliff & Berridge, PLC

(57) ABSTRACT

A high pressure discharge lamp 1A has a light emitting vessel 2A made of a semitransparent ceramic material and having a pair of end portions 2*a* each with an opening formed in the end portion and a light emitting portion 2*a*, a pair of discharge electrodes 5, and electrode supporting members 4 each supporting the electrode 5 and fixed to the end portion 2*a*. The vessel 2A defines an inner space 6 with an ionizable light emitting substance and starter gas filled in the inner space 6. The electrodes 5 are contained in the inner space 6. The light emitting portion 2*b* has a thicker portion 2*g* and a thinner portion 2*c*. The thinner portion 2*c* has a cross sectional area of not smaller than 35 percent and not larger than 80 percent of that of the thicker portion 2*g* so that the light emitting portion 2*b* has a brightness center 9 in the thinner portion 2*c*.

13 Claims, 10 Drawing Sheets

HIGH PRESSURE DISCHARGE LAMPS, LIGHTING SYSTEMS, HEAD LAMPS FOR AUTOMOBILES AND LIGHT EMITTING VESSELS FOR HIGH PRESSURE DISCHARGE LAMPS

This application claims the benefits of a Japanese Patent Application P2002-218422 filed on Jul. 26, 2002 and a PCT application PCT/JP01/08674 filed on Oct. 2, 2001, the entireties of which are incorporated by reference.

BACKGROUND OF THE INVENTION

1. Field of the Invention

The present invention relates to a high pressure discharge lamp suitable for a head lamp for an automobile or the like.

2. Related Art Statement

A high pressure discharge lamp with a discharge vessel of quartz has been widely used as a head light for an automobile due to its high brightness and light emission efficiency. The discharge vessel has a light emitting portion and contains a light emitting gas inside of the vessel. The discharge vessel of such discharge lamp is made of quartz and thus transparent, so that the light emitting portion may function as a point light source.

A Japanese patent publication 5-74204A (74204/1993) disclosed a head lamp for an automobile. The lamp has a discharge valve, a vessel for shielding ultraviolet rays and containing the valve, and a reflector. The reflector reflects and projects light emitted by the valve. A Japanese patent publication 5-8684A (8684A/1993) disclosed a head lamp for an automobile having a combination of a metal halide lamp and a high pressure sodium lamp as light sources for the head lamp.

The applicant filed a Japanese patent publication 2001-76677A, and disclosed a high pressure discharge lamp usable as a pseudo point light source for an automobile head lamp. According to the description in the publication, when a light emitter is contained within a light emitting vessel made of quartz and powered, the inner light emitter in the transparent quartz vessel may be shown from the outside of the vessel. The light emitter may thereby function as a point light source. On the contrary, a high pressure discharge lamp using a vessel of a translucent polycrystalline alumina is semitransparent, so that the whole of the vessel functions as an integral light emitter when observed from the outside of the vessel. It is thereby necessary to sufficiently miniaturize the light emitting vessel itself so that the vessel may function as a pseudo point light source. For example, the light emitting vessel has a length of 6 to 15 mm and an arc length in the vessel is 1 to 6 mm. The publication disclosed a novel structure for realizing a high pressure discharge lamp using the light emitting vessel of such a small size.

SUMMARY OF THE INVENTION

For example in a head lamp for an automobile, a light emitting vessel is set on a predetermined position. Light emitted from the vessel is then reflected by a reflector to project the reflected light forwardly. The relationship of three dimensional positions of the point light source and reflector, as well as the surface shape of the reflector, are accurately determined, so as to avoid a reduction of condensing efficiency at a focal point. Furthermore, a head lamp for an automobile is operated by switching two lighting modes: running mode and low beam mode. As well known, the head lamp condenses and projects the light beam forwardly in the running mode. The light beam is projected lower in the low beam mode. When a head lamp for an automobile use a high pressure discharge lamp as a pseudo point light source, it is necessary to change the relationship of the positions of the lamp and reflector, corresponding with the different lighting modes, to change the focal point of the projected light beam.

When a light emitting vessel of a high pressure discharge lamp is used as a pseudo point light source, however, it proved to be actually difficult to present an appropriate design satisfying the following two conditions.

(a) To change the relationship between the three dimensional positions of the vessel and reflector to change the focal point of the projected light beam, corresponding to the different lighting modes.

(b) To concentrate the projected light beam at the respective focal points at high efficiencies, corresponding to the respective lighting modes.

The inventor has encountered the following problems. For example, the positions of the light emitting vessel and reflector may be accurately adjusted in the running mode so that the focal point of the light beam is adjusted at a specified point. It is, however, difficult to adjust the projected beam at a specified point by moving the reflector in the low beam mode, according to limitations on the design. This is mainly due to the fact that the vessel is relatively large in size. It is generally effective, for solving the above problems to make the light emitting vessel smaller. As the light emitting vessel is smaller, the production becomes more difficult so that the manufacturing costs may be increased.

When a high pressure discharge lamp using a light emitting vessel made of a translucent polycrystalline alumina is applied for a head lamp for an automobile with a reflector, cracks may be observed in the vessel, after a high energy is supplied to perform lighting cycles of turning-ons and turning-offs over a long period of time. In a head lamp for an automobile using a quartz light emitting vessel, such crack formation are not observed even after electric power higher than a rated voltage is supplied to perform lightning cycles of turning ons and turning offs over a long period of time.

An object of the present invention is to provide a novel high pressure discharge lamp for projecting light and to facilitate the design for improving the condensing efficiency of the projected light at a focal point when the lamp is applied as a pseudo point light source.

Another object of the invention is to provide a novel high pressure discharge lamp having a structure for preventing crack formation in a light emitting vessel after a high energy is supplied to the lamp to perform lighting cycles of turning-ons and turning-offs over a long period of time, when the lamp is used as a pseudo point light source.

The present invention provides a high pressure discharge lamp comprising a light emitting vessel made of a semi-transparent ceramic material and having a pair of end portions each with an opening formed in the end portion and a light emitting portion. The lamp further has a pair of discharge electrodes and electrode supporting members each supporting the electrode and fixed to the end portion. An ionizable light emitting substance and a starter gas are filled in the inner space of the vessel. The electrodes are also contained in the inner space. The light emitting portion has a thicker portion and a thinner portion. The thinner portion has a cross sectional area of not smaller than 35 percent and not larger than 80 percent of that of the thicker portion so that the light emitting portion has a brightness center in the thinner portion.

The present invention further provides a head lamp for an automobile comprising the high pressure discharge lamp as a pseudo point light source.

The invention further provides a light emitting vessel for a high pressure discharge lamp. The light emitting vessel is made of a semitransparent ceramic material and has a pair of end portions each with an opening formed in the end portion and a light emitting portion. The light emitting vessel defines an inner space. An ionizable light emitting substance and starter gas are filled in the inner space. The light emitting portion has a thicker portion and a thinner portion, and the thinner portion has a cross sectional area of not smaller than 35 percent and not larger than 80 percent of that of the thicker portion.

The inventor has reached the idea of providing thicker and thinner portions in the light emitting portion and adjusting the cross sectional area of the thinner portion at a value of not smaller than 35 percent and not higher than 80 percent of that of the thicker portion. The brightness center of the light emitting vessel may be thus positioned in the light thinner portion.

That is, when a transparent light emitting vessel such as a quartz tube is used, a light emitter in the light emitting vessel may be observed directly through the transparent vessel from the outside of the vessel. The light emitter may thus function as a point light source. In this case, it is possible to adjust the focal point of the projected and reflected light beam, by adjusting the positions of the light emitter in the quartz vessel and the reflector.

Contrary to this, the inventor has applied a semitransparent light emitting vessel made of a translucent ceramic material so that the whole of the light emitting vessel may function as a pseudo point light source. At the same time, the inventor tried to provide a thinner portion in the light emitting portion of the vessel so that the thinner portion emits more light fluxes than the thicker portion, so that the brightness center is located in the thinner portion. The position and dimension of the thinner portion may be easily and freely selected in the light emitting portion. It is therefore possible to appropriately adjust the position of the brightness center and the distribution of brightness in the light emitting vessel, by appropriately adjust the position and dimension of the thinner portion in the vessel.

A high pressure discharge lamp of the invention may be used as a pseudo point light source to provide a lighting system, light emission from the light emitting vessel may be used for projection. In this case, it is possible to design the position and shape of each optical device on the provision that the position of the brightness center is deemed as a point light source. It is thus possible to facilitate the design of the lighting system, and to improve the condensing efficiency of the projected light beam at a focal point at the same time.

It has been further found that crack formation in the light emitting vessel may be prevented, when the discharge lamp is used as a pseudo point light source, after a high energy is supplied to the lamp to perform lighting cycles of turning ons and offs over a long time period.

These and other objects, features and advantages of the invention will be appreciated upon reading the following description of the invention when taken in conjunction with the attached drawings, with the understanding that some modifications, variations and changes of the same could be made by the skilled person in the art.

PREFERRED EMBODIMENTS OF THE INVENTION

Figure 1:
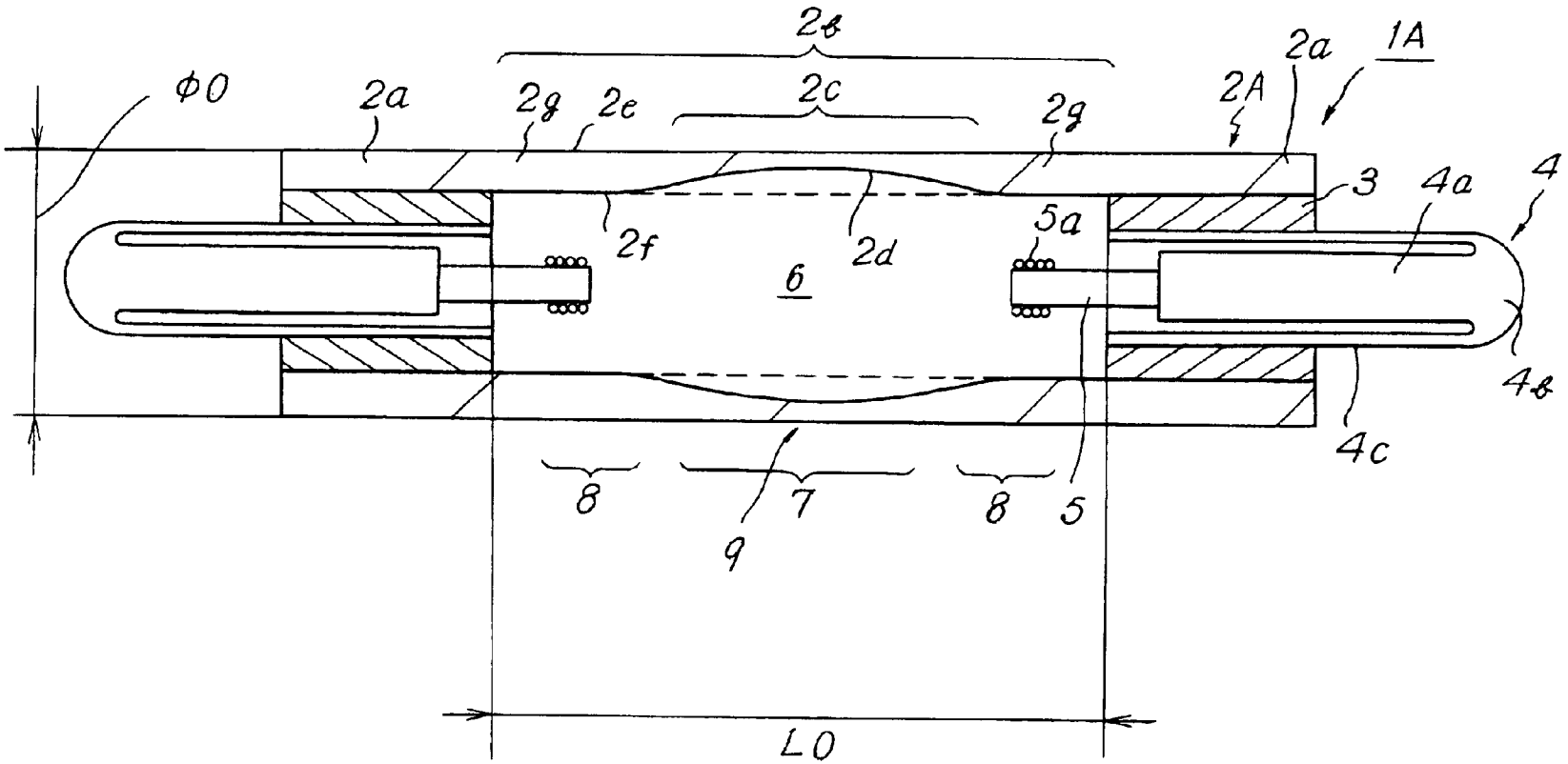
FIG. 1 is a longitudinal sectional view schematically showing a high pressure discharge lamp 1A according to one embodiment of the present invention, in which a light emitting portion 2*b* has thicker portions 2*g* and one thinner portion 2*c*.
Figure 2:
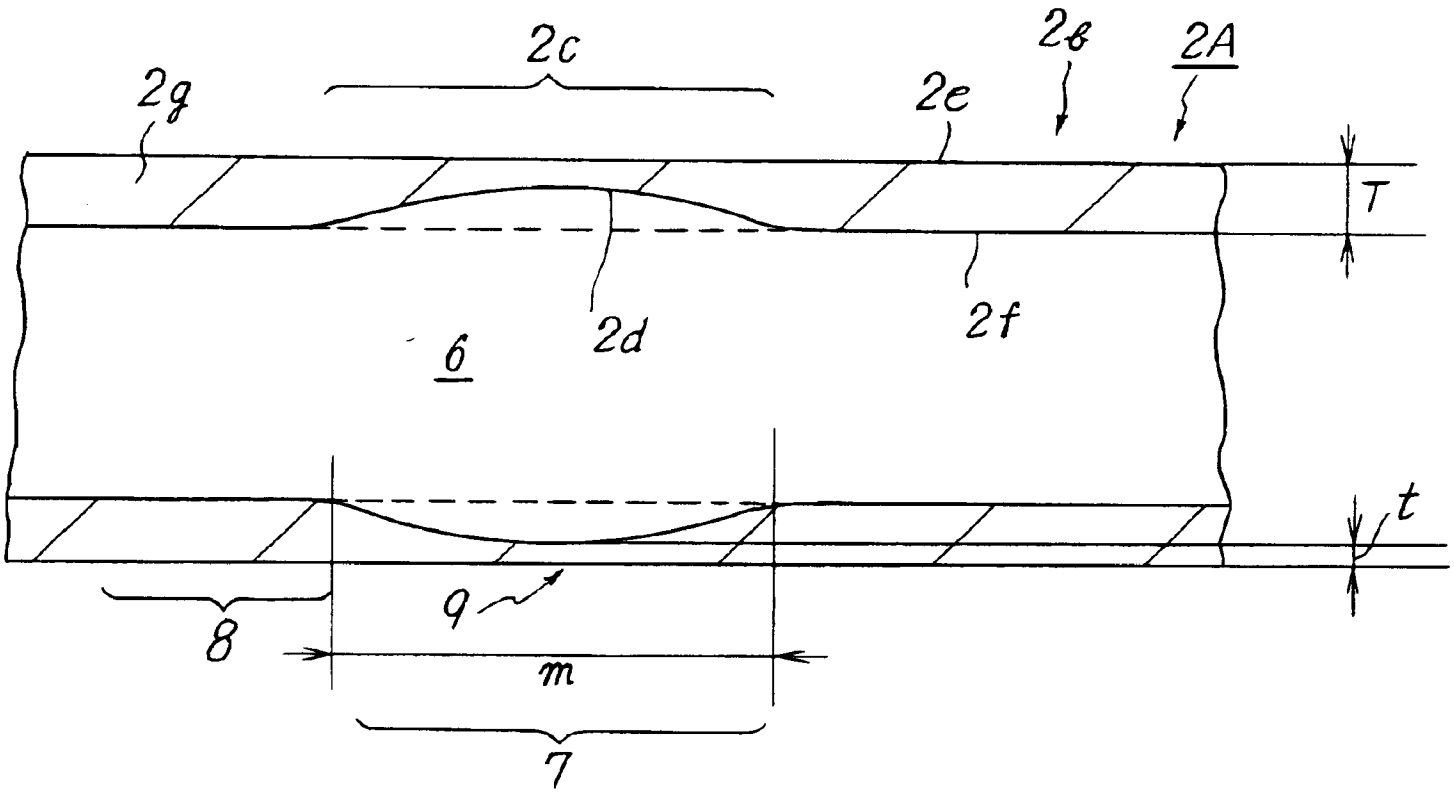
FIG. 2 is a longitudinal sectional view schematically showing an important part of a light emitting vessel 2A of the high pressure discharge lamp of FIG. 1.

FIG. 1 is a longitudinal and sectional view showing a high pressure discharge vessel 1A according to one embodiment of the present invention, and FIG. 2 is a longitudinal and sectional view showing an important part of a light emitting vessel 2A.

The light emitting vessel 2A has a pair of end portions 2*a* and one light emitting portion 2*b* between the end portions 2*a*. Each end portion 2*a* has an inner opening so that an electrode supporting member 4 is inserted and fixed within the opening through a joining material 3. An ionizable light emitting substance and a starter gas are filled in an inner space 6 of the light emitting vessel 2A. In the case of a metal halide high pressure discharge lamp, an inert gas such as argon and xenon and a metal halide, as well as mercury or a zinc metal if required, are filled in the inner space of the discharge vessel.

The electrode supporting member 4 has a cylindrical portion 4*c*, a base portion welded with the end of the cylindrical portion 4*c* and an electrode supporting portion 4*a* protruding inside of the base portion 4*b*. The electrode supporting portion 4*a* is cylindrical shaped in the present example. An electrode 5 protrudes from the inner end of the electrode supporting portion 4*a*. A coil 5*a* is wound onto the end of the electrode 5 in the present example. Such coil 5*a* may be omitted.

As shown in FIG. 2, the light emitting vessel 2A has an outer surface 2*e* with no recess or protrusion formed thereon. The outer diameter of the light emitting vessel 2A is substantially constant in the light emitting portion 2*b*. The light emitting vessel 2A has an inner surface 2*f* with a recess 2*d* formed therein, so that the thinner portion 2*c* is thus formed. In the present example, one continuous thinner portion 2*c* is formed in the light emitting portion 2*b*.

Electric power is supplied to the high pressure discharge lamp 1A to induce discharge arc between a pair of the electrodes 5 so that the ionizable light emitting substance emits light. The light emission from the substance produces light fluxes over the whole of the light emitting portion 2*c* of the light emitting vessel. The thinner portion 2*c* has a light transmittance lower than that of the thicker portion 2*g* so that the thinner portion 2*c* mainly emits light. As a result, a brighter portion 7 is formed in the thinner portion 2*c* and a darker portion 8 is formed in the thicker portion 2*g* in the portion 2*b*. The point 9 having the smallest thickness in the thinner portion 2*c* is the center of brightness. The brightness center is extended along the outer surface of the light emitting vessel 1A to form a ring-shaped brightest portion in the vessel.

Figure 3:
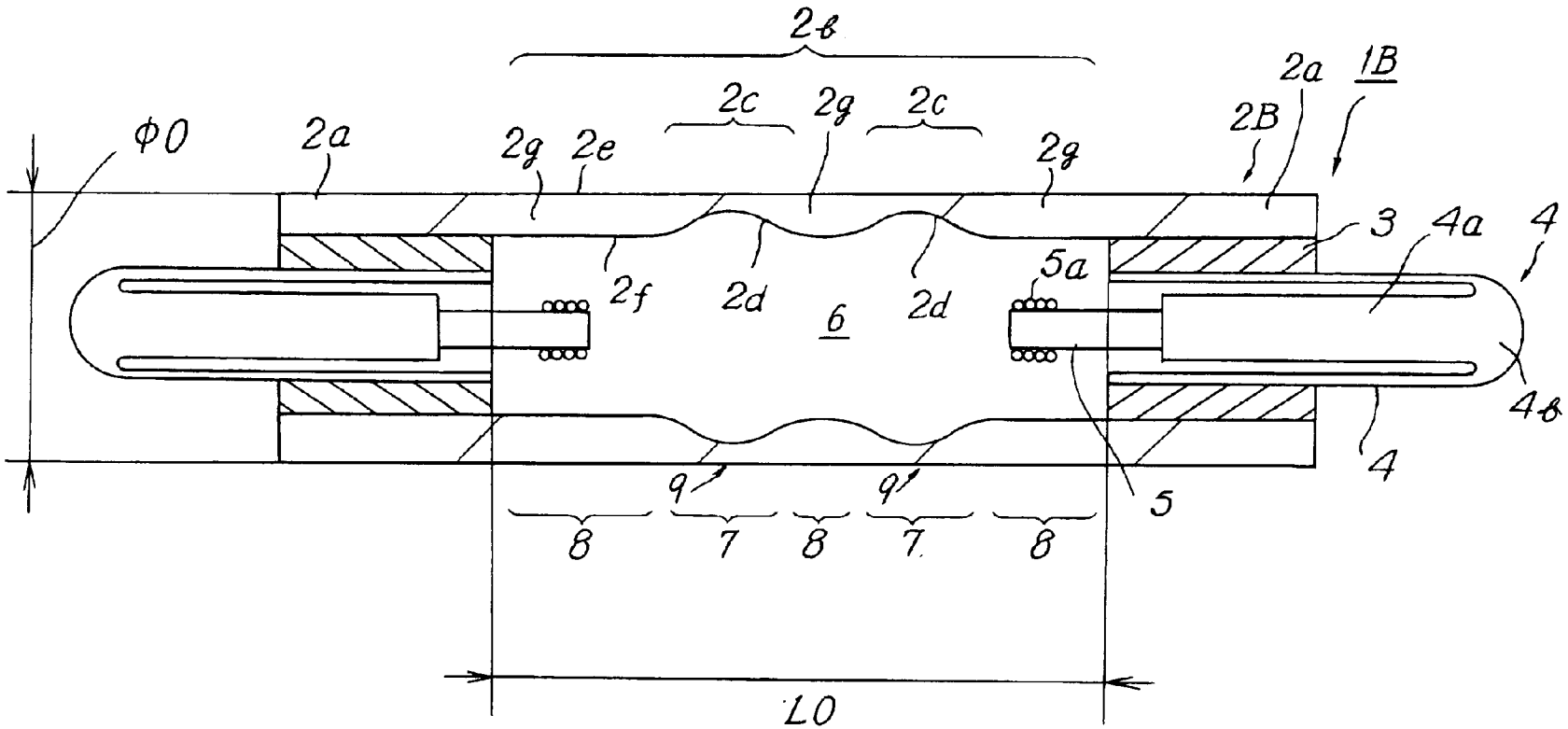
FIG. 3 is a longitudinal sectional view schematically showing a high pressure discharge lamp 1B according to another embodiment of the present invention.

A high pressure discharge lamp 1B shown in FIG. 3 has parts substantially same as those shown in FIG. 1. The parts are specified by the same numerals as those used in FIG. 1 and the explanation may be omitted.

The high pressure discharge lamp 1B has a light emitting vessel 2B whose light emitting portion 2*b* has two thinner portions 2*c*. Thicker portions 2*g* are provided between the thinner portions 2*c* and the outside of each thinner portion. The light emitting vessel 2B has an outer surface 2*e* with no recess or protrusion provided thereon. The outer diameter of the vessel 2B is substantially constant in the light emitting portion 2*b*. The light emitting vessel 2B has an inner surface 2*f* with two recesses 2*d* formed thereon, so that the thinner portions 2*c* are provided corresponding to the respective recesses.

Electric power is supplied to the high pressure discharge lamp 1B to emit light fluxes from the whole of the light emitting portion 2*b* of the light emitting vessel. Each thinner portion 2*c* has a light transmittance lower than that of each thicker portion 2*g* so that the thinner portion 2*c* mainly emits light. Each of the portions 9 having the smallest thickness in the thinner portion 2*c* is the center of brightness. The brightness center is extended along the outer surface of the light emitting vessel 1B to form a ring-shaped brightest portion in the vessel.

Figure 5:
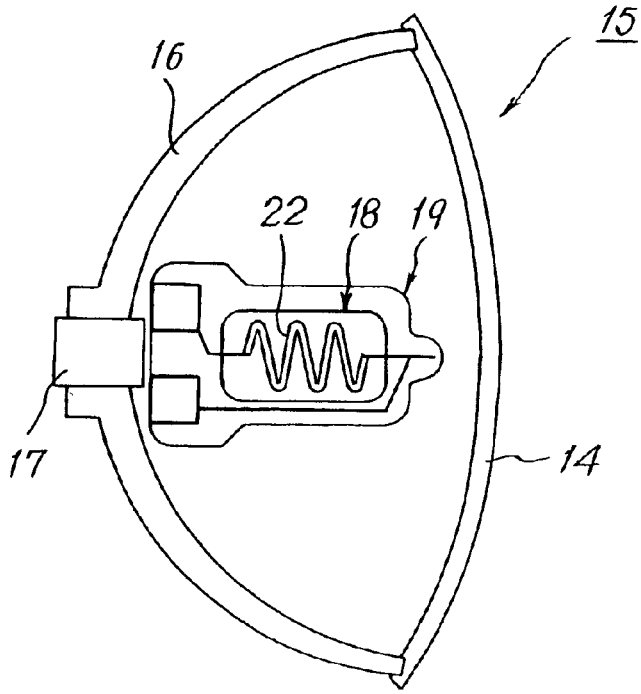
FIG. 5 is a schematic view showing a head lamp 15 for an automobile using a quartz vessel 18.

FIG. 5 is a schematic view showing a head lamp 15 for an automobile using a quartz vessel 18. The quartz vessel 18 is contained in a container 19. The container 19 is fixed to a base part 17 of an outer container 16 having a reflector. A window 14 is provided on the front of the lamp 15. A light emitter 22 is provided inside of the quartz vessel 18.

Figure 6:
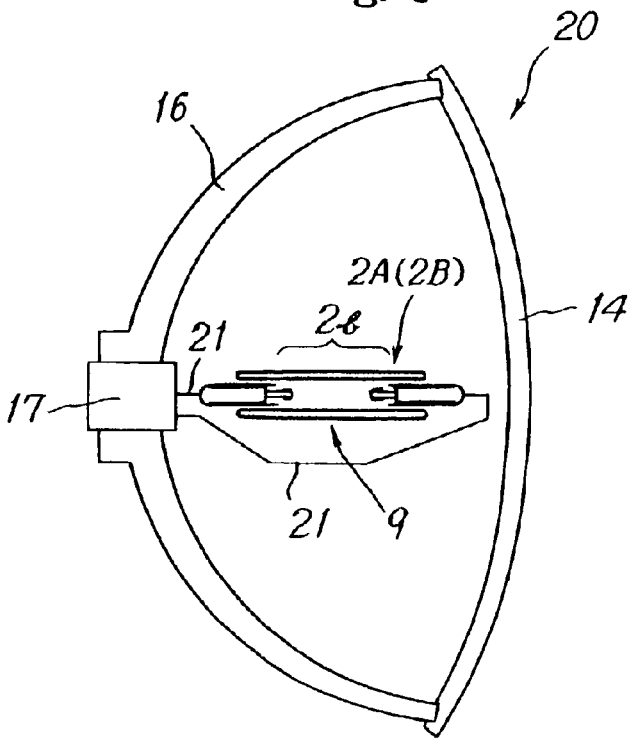
FIG. 6 is a schematic view showing a head lamp 20 for an automobile using the high pressure discharge lamp 2A or 2*b*.

FIG. 6 is a schematic view showing a head lamp 20 for an automobile equipped with a high pressure discharge lamp. 21 is an electrical connecting means.

In FIG. 5, the light emitting vessel 18 is made of quartz and transparent. It is thus required only the light emitter 22 itself has an outer diameter and a length so that the light emitter may function as a point light source.

In a head lamp for an automobile shown in FIG. 6, the light emitting vessel 2A or 2B emits light as a whole. It is thus required that the whole of the light emitting portion functions as a pseudo point light source. In other words, it is preferred that the light emitting vessel 2A or 2B has an outer diameter and length of the substantially same level as those of the light emitter 22 (see FIG. 5).

From this point of view, the light emitting portion 2*b* may preferably have a length "LO" of not larger than 15 mm and an outer diameter φ0 of not larger than 6 mm (see FIGS. 1 to 4). Furthermore, it is needed that the discharge arc length is about 1 to 5 mm in general. It is possible to provide an arc length of not shorter than 1 mm in the inner space 6, by providing the light emitting vessel having a length of not smaller than 6 mm.

According to the present invention, a part of the light emitting portion 2*b* is made the center of brightness and light fluxes are concentrated at and around the brightness center. It is thus possible to design the reflector or another optical devices for generating the projected light beam on the provision that the brightness center is deemed as a point light source. It is thus possible to facilitate the design for improving the condensing efficiency of the projected light beam at the focal point of the beam, compared with a prior lighting system.

The light emitting vessel may be formed of a semitransparent or translucent ceramic material as the followings.

Polycrystalline $Al_2O_3$, AlN or AlON

Single crystal of $Al_2O_3$, YAG, $Y_2O_3$ or the like having a surface roughness Ra of not smaller than 1.0 $\mu$m The semitransparent material has a total light transmittance of not lower than 85 percent and a linear light transmittance of not lower than 30 percent.

Materials for the discharge electrode and electrode supporting member are not particularly limited. Such material may preferably be a pure metal selected from the group consisting of tungsten, molybdenum, rhenium and tantalum, or an alloy of two or more metals selected from the group consisting of tungsten, molybdenum, rhenium and tantalum. Tungsten, molybdenum or an alloy of tungsten and molybdenum is particularly preferred. Further, it is preferred a composite material of the pure metal or alloy described above and a ceramic material.

The thicker portion is a portion having a larger thickness in the light emitting portion. The thinner portion is a portion having a smaller thickness in the light emitting portion.

According to the present invention, the thinner portion has a cross sectional area of not smaller than 35 percent and not larger than 80 percent of that of the thicker portion. When the cross sectional area of the thinner portion is larger than 80 percent of that of the thicker portion, the difference of the brightness in the thinner and thicker portions are reduced so that the effect of the invention may not be obtained. From this point of view, the cross sectional area of the thinner portion may preferably be not larger than 70 percent of that of the thicker portion. When the cross sectional area of the thinner portion is smaller than 35 percent of that of the thicker portion, cracks tend to be observed in the thinner portion after lighting cycles. The cross sectional area of the thinner portion is required to be not smaller than 35 percent of that of the thicker portion, for assuring a sufficient mechanical strength of the thinner portion. From this point of view, the cross sectional area of the thinner portion may preferably be not smaller than 50 percent of that of the thicker portion.

In the examples shown in FIGS. 1 to 4, the cross sectional area of the thinner portion 2*c* is larger near the thicker portion 2*g*, and smaller near the brightness center 9 and smallest in the brightness center 9 having the smallest thickness. When the cross sectional area of the thinner portion is changed stepwise or gradually, the "cross sectional area of the thinner portion" is defined as a minimum value of the cross sectional area of the thinner portion.

Further, the thickness of the thinner portion 2*c* may be substantially constant over the whole of the thinner portion. In this case, the cross sectional area of the thinner portion is made substantially constant over the whole length of the thinner portion. In this case, however, the thickness is discontinuously changed along the interface of the thicker and thinner portions. It is considered that cracks tend to be formed along the interface in the light emitting vessel during lighting cycles. The cross sectional area of the thinner portion may preferably be continuously changed between the brightness center and the interface of the thicker and thinner portions.

The brightness center means a part having the highest brightness in the light emitting portion. It is not required that the brightness center is defined as a single point, and the brightness center may be defined as an area elongating in the longitudinal direction of the light emitting vessel.

Light fluxes per an unit area emitted from the brightness center may preferably be not smaller than 1.5 times, and more preferably be not smaller than 2 times, of that emitted from the darker portion 8.

In a preferred embodiment, the outer diameter of the light emitting vessel is substantially constant over the whole length of the light emitting portion. It is thus possible to improve the symmetric property of the projected light beam, by making the outer diameter of the light emitting vessel substantially constant, when the light emitting vessel is used as a pseudo point light source.

In a preferred embodiment, a recess is formed on the inner surface of the light emitting vessel to form the thinner portion. The advantages will be described.

Figure 7:
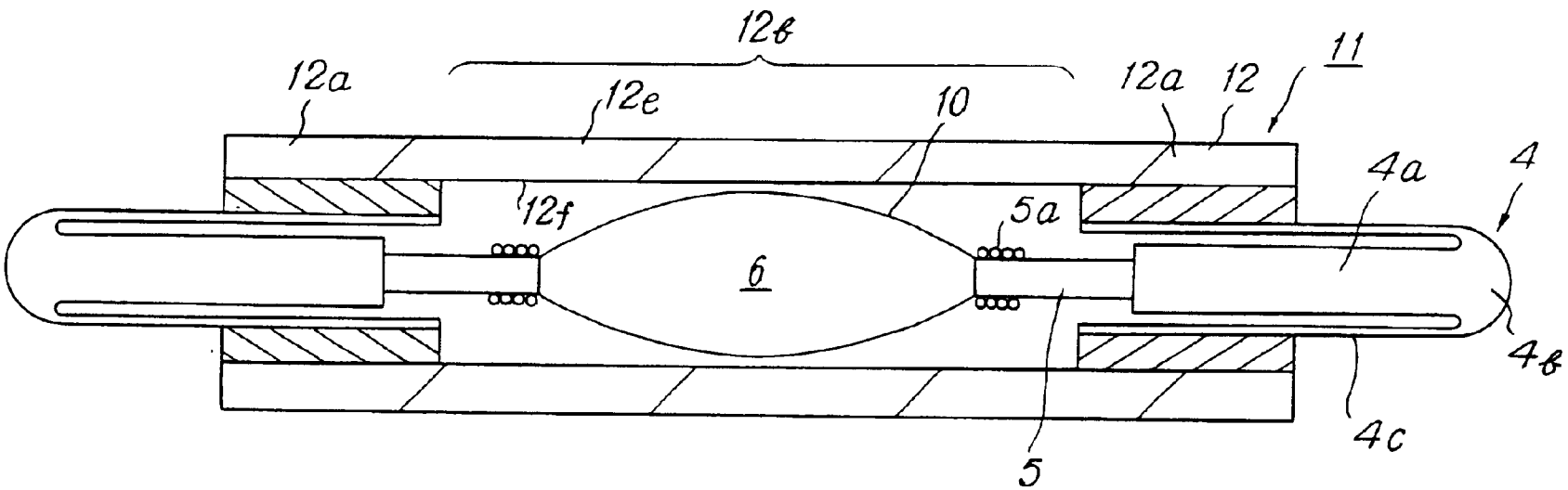
FIG. 7 is a longitudinal sectional view schematically showing a high pressure discharge lamp 11 according to a comparative example.

FIG. 7 is a longitudinal cross sectional view schematically showing a high pressure discharge lamp 11 according to a comparative example.

A light emitting vessel 12 has a pair of end portions 12*a* each having an opening formed therein and a light emitting portion 12*b* between the end portions. A recess or protrusion is not formed on the outer surface 12*e* and inner surface 12*f* of the light emitting vessel 12. Each of the inner and outer diameters of the light emitting vessel 12 is substantially constant.

Electric power is supplied to the high pressure discharge lamp to induce discharge arc between a pair of electrodes 5. When the lamp 11 is horizontally supported and fixed, the discharge ark 10 tends to inflate toward the upper region in the inner space 6. As a result, a temperature in the upper region in the inner space is increased compared with that in the lower region in the space 6. When the light emission is terminated, the upper portion of the vessel is cooled to shrink in a shorter time period compared with the lower portion, so that a tensile stress may be induced in the lower portion of the vessel. Such tensile stress may be a cause of crack formation in the ceramic material constituting the vessel.

To avoid the problems, it is necessary to set a maximum temperature in the upper region at a value as low as possible for providing a larger tolerance, so as to avoid the excessive increase of the temperature in the upper region. In this case, however, the temperature in the ends of the lower region may be excessively reduced, so that an ionizable light emitting substance tends to be liquefied to reduce the light emission efficiency.

On the contrary, a recess may be formed on the inner surface of the light emitting vessel, so that the heat transfer from the discharge arc to the light emitting vessel may be reduced in the recess. The temperature rise in the light emitting vessel may be thus reduced. It is thereby possible to prevent the local temperature rise in the light emitting vessel when the discharge arc inflates toward the inner surface of the vessel, as described above.

In a particularly preferred embodiment, one thinner portion may be provided in the light emitting vessel as described in FIGS. 1 and 2. Most preferably only one recess 2*d* is provided. The recess 2 faces the inner space 6 of the light emitting vessel. In this case, the whole of the inner space 6 and the recess 2*d* has a shape similar to the shape of the discharge arc 10, so that the local temperature rise in the light emitting vessel may be further prevented.

A high pressure discharge lamp according to the present invention may be used in a lighting system using a reflector, providing the following advantages.

In the present embodiment, a semitransparent light emitting vessel is used as a pseudo point light source, and light emitted from the vessel is reflected by a reflector to project the reflected light forwardly. In this embodiment, after a test of supplying a high electric power to the light emitting vessel for performing lighting cycles of turning-ons and turning-offs at a high electric power over a long period of time, cracks may be observed in the vessel. When a filament 22 in a light emitting vessel is used as a point light source as shown in FIG. 5, such problem of crack formation was not observed.

The causes may be considered as follows. That is, when a light emitting vessel is transparent and the light emitter 22 in the vessel is used as a point light source as shown in FIG. 5, light radiated from the point light source passes through the vessel and then reflected by a reflector 16. The reflected light is then projected forwardly. In this case, as far as the relationship of the positions of the reflector 16 and point light source 22 is accurately adjusted, only a small amount of light fluxes are incident into the vessel again after reflected by the reflector 16.

Figure 8:
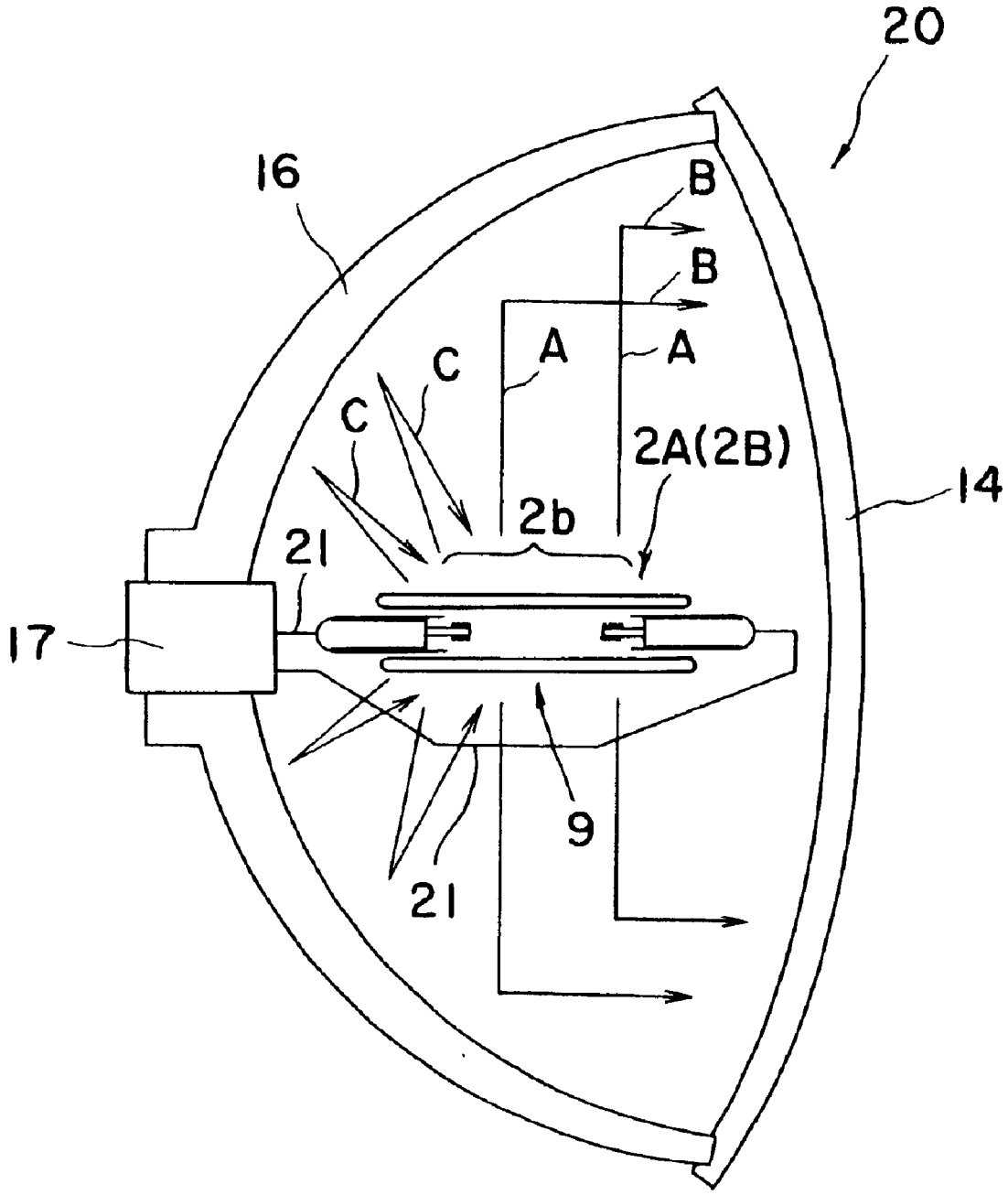
FIG. 8 is a schematic view for describing the reflection of light in the head lamp 20 for an automobile.
Figure 9:
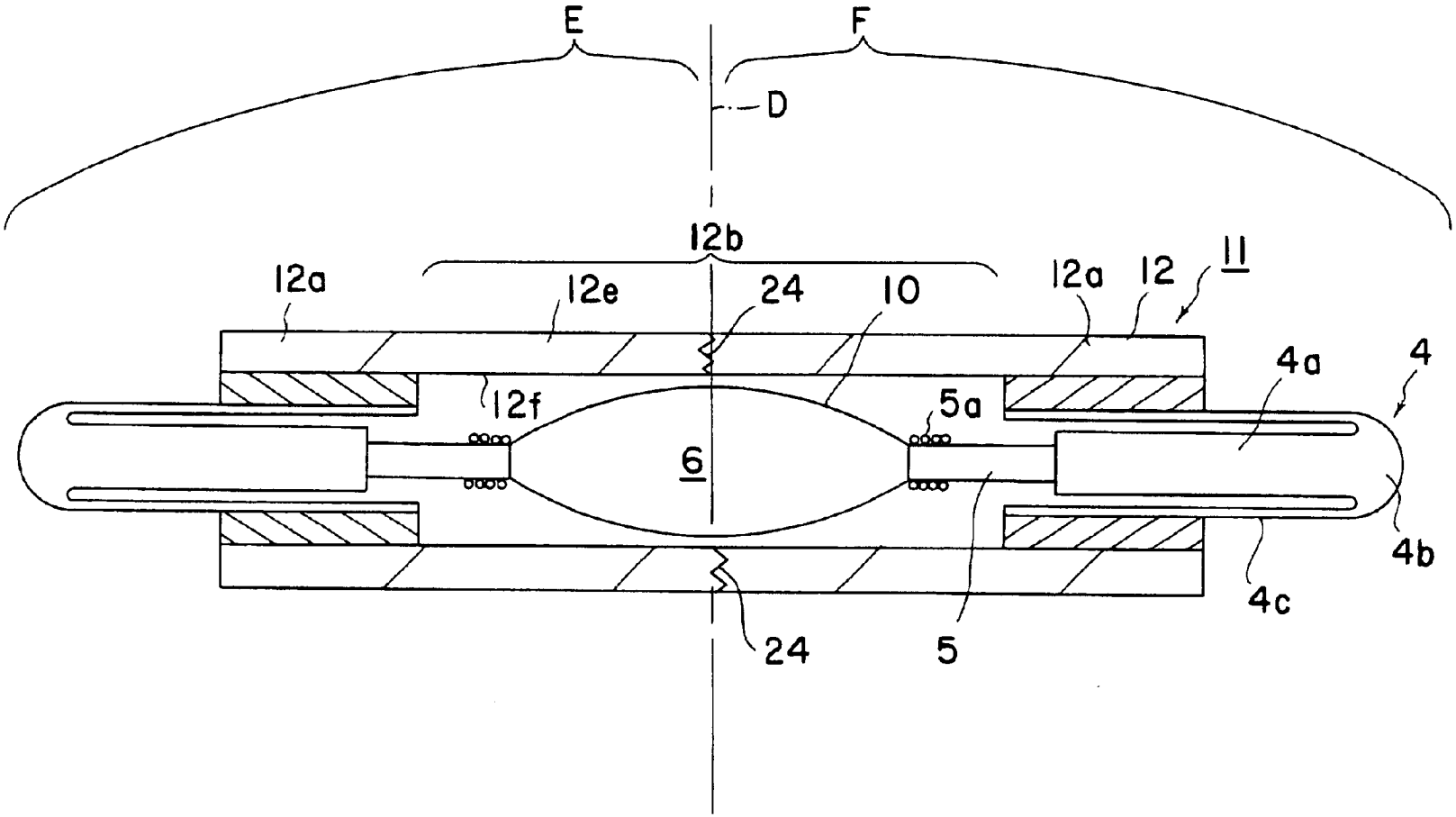
FIG. 9 is a longitudinal sectional and schematic view of the high pressure discharge lamp 11 according to a comparative example for describing the mechanisms of crack formation.

On the contrary, when the light emitting vessel is used as a pseudo point light source, the temperature of a right half of the vessel may be different from that of the left half. That is, as shown in FIG. 8, it is provided that infrared light is emitted from a light emitting vessel 2A (2B, 11) as arrows A. A substantial portion of the infrared light should be reflected by the reflector 16 and projected forwardly as arrows B. When the light emitting vessel is semitransparent, however, the emitted light is reflected at the surface of the reflector 16 randomly at a some degree, due to reasons such as scattering of light in the light emitting vessel. A part of the reflected light may be incident into the inside of the vessel 2A (2B, 11) again as arrows C. As shown in FIG. 9, a larger amount of fluxes of infrared light is supplied into a half E of the vessel 11 nearer to the reflector and smaller amount of fluxes of infrared light is incident into the other half F distant from the reflector. As a result, the temperature in the half E may be different from that in the half F.

When the lamp is turned on, it is common to elevate the temperature in the light emitting vessel as high as possible for improving the light emission efficiency of the discharge lamp. For example, when the vessel is made of polycrystalline alumina, the lamp is turned on at a high temperature slightly lower than 1200° C., which is substantially a softening point of polycrystalline alumina. Even if the temperature in the half E is different from that in the half F when the lamp is turned on, a stress along an interface D between the halves E and F may be relaxed due to the softening of the vessel to avoid crack formation therein.

On the other hand, energy supply from the discharge arc is momentarily terminated and thermal emission from the inner space of the vessel starts, right after the lamp is turned off. As shown in FIG. 9, the thermal emission is mainly composed of thermal conduction through the electrodes 4 and thermal radiation from the light emitting vessel 12 to atmosphere. The vessel and electrodes are substantially symmetrical with respect to a line D shown in FIG. 9. An amount of the thermal emission is considered to be substantially same in the halves E and F. In the beginning of cooling stage, the temperature of the light emitting vessel is reduced substantially below the softening point of the vessel while maintaining the temperature difference in the halves E and F. A substantial stress may be thus induced. As a result, cracks 24 may be formed.

Figure 10:
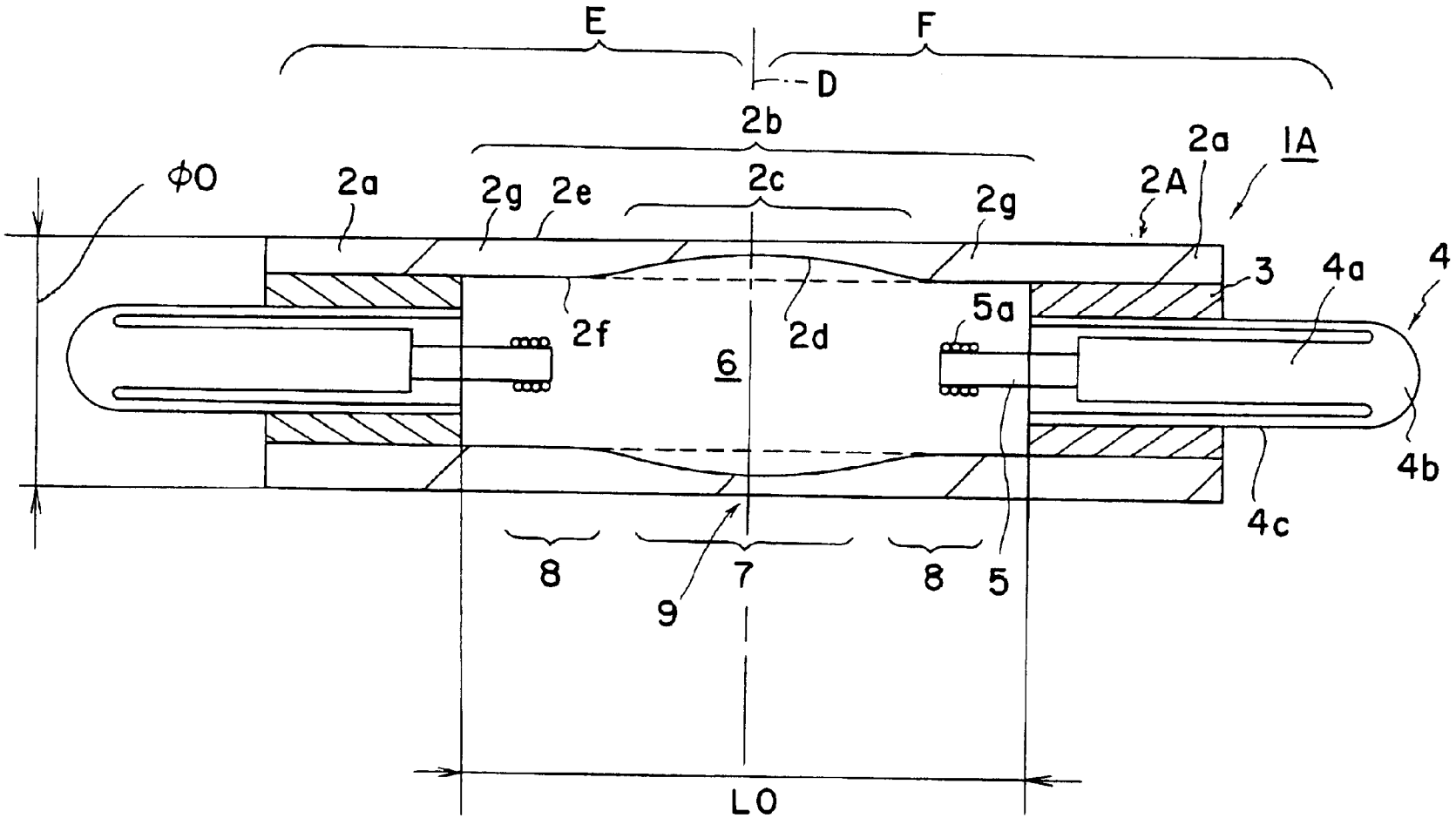
FIG. 10 is a longitudinal and schematic section showing halves E and F of the high pressure discharge lamp 1A according to the present invention.

On the contrary, as shown in FIG. 10, the thinner portion 7 and brightness center 9 are provided in the light emitting vessel. In this structure, it is considered that crack formation may be prevented according to the following mechanism. That is, when the light emitting vessel 2A is cooled while the temperature difference in the halves E and F is maintained, a stress may be induced due to the temperature difference, particularly along the interface D. In the thinner portion 7, however, crack formation might be reduced compared with that in the thicker portion. Moreover, in the present invention, the brightness center 9 is provided. The brightness center 9 may be effective for reducing irregular reflection at the surface of the reflector compared with the vessel having a constant thickness over the whole length of the vessel. It is thus possible to reduce the incidence of infrared light into the half E after the light is reflected by the reflector. The synergistic effect of the above mechanisms may prevent the crack formation in the vessel.

Figure 4:
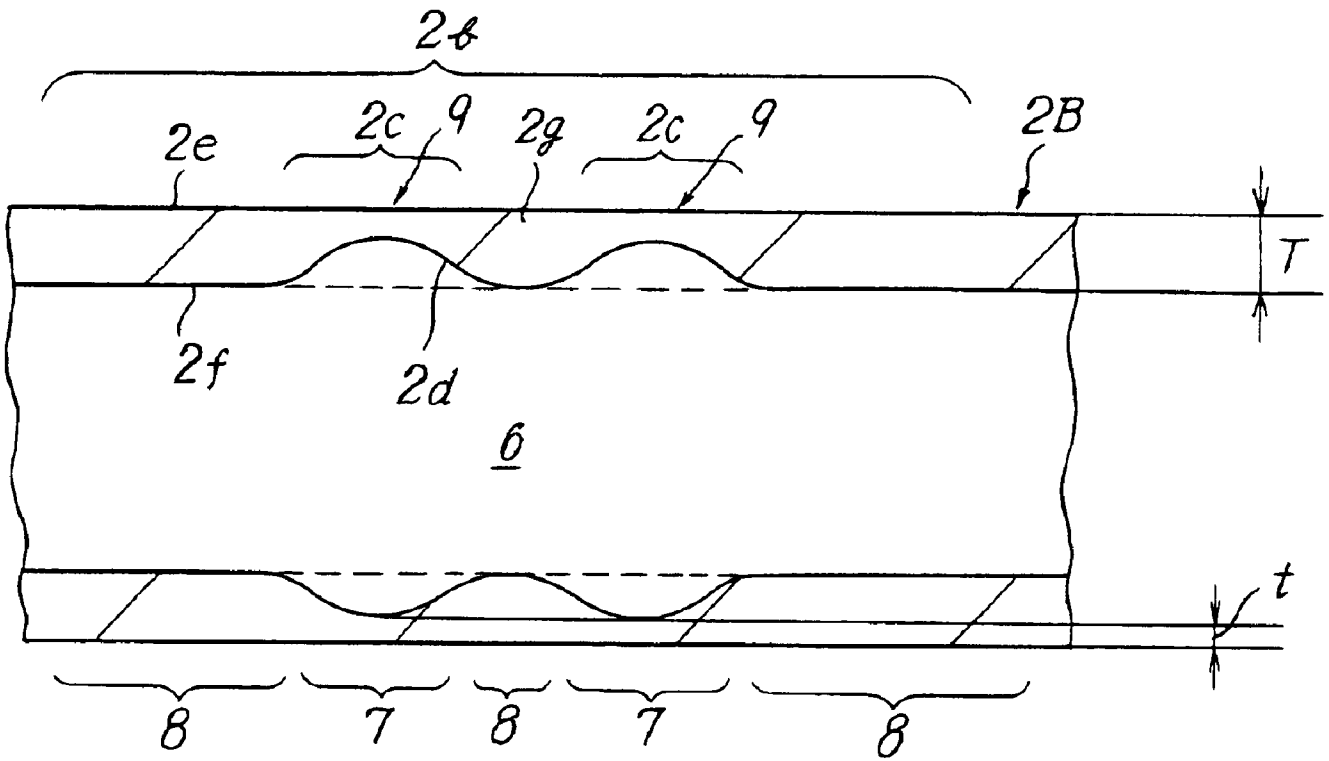
FIG. 4 is a longitudinal sectional view schematically showing an important part of a light emitting vessel 2B of the high pressure discharge lamp of FIG. 3.

Preferred dimensions of the light emitting vessel will be described, referring to FIGS. 2 and 4.

From the viewpoint of the effects of the present invention, the thinner portion 2*c* may preferably have a length "m" as small as possible. For example the length "m" may preferably be not larger than 0.7 times, and more preferably be not larger than 0.5 times, of the whole length "LO" of the light emitting portion 2*b*. When the length "m" of the thinner portion 2*c* is too small, light fluxes emitted from the thinner portion are reduced so that the thinner portion may not properly function as a brighter portion. The length "m" may preferably be not smaller than 0.2 times of "LO" on the viewpoint.

The ratio T/t of the thickness of the thicker portion "T" to the thickness of the thinner portion "t" may be calculated from the ratio of their cross sectional areas described above.

The thickness "T" of the thicker portion may preferably be not smaller than 0.8 mm and more preferably be not smaller than 1.1 mm, for providing a high mechanical strength to the light emitting vessel and improving the life when the vessel is to be used over a long period of time. Further, when the thickness "T" of the thicker portion is too large, the light emission efficiency of the vessel may be reduced. The thickness "T" of the thicker portion may preferably be not larger than 0.85 mm and more preferably not larger than 0.55 mm, for improving the light emission efficiency of the vessel.

The thickness "t" of the thinner portion may preferably be not smaller than 0.6 mm and more preferably be not smaller than 0.9 mm, for providing a high mechanical strength to the vessel and improving the life when the vessel is to be used over a long period of time. When the thickness "t" of the thinner portion is larger, light fluxes emitted from the brightness center is reduced. The thickness "t" of the thinner portion may preferably be not larger than 0.7 mm and more preferably be not larger than 0.4 mm, from the viewpoint of the effects of the present invention.

A joining material 3 is not particularly limited and includes the followings.

(1) A ceramic material selected from the group consisting of alumina, magnesia, yttria, lanthania and zirconia, or a mixture of a plurality of ceramic materials selected from the group consisting of alumina, magnesia, yttria, lanthania and zirconia.

(2) Cermet consisting of a ceramic material and metal. The ceramic material may be a ceramic material selected from the group consisting of alumina, magnesia, yttria, lanthania and zirconia, or a mixture of a plurality of ceramic materials selected from the group consisting of alumina, magnesia, yttria, lanthania and zirconia.

The metal may preferably be tungsten, molybdenum, rhenium, or the alloy of two or more metals selected from the group consisting of tungsten, molybdenum and rhenium. It is thus possible to improve the anti-corrosion property against a metal halide to the cermet by selecting the above metal or alloy. The cermet may contain a ceramic component preferably in an amount of not lower than 55 weight percent and more preferably in an amount of not lower than 60 weight percent (the balance is a metal component).

(3) A joining material obtained by producing a porous metal having open pores therein (porous bone structure) and impregnating a ceramic composition into the open pores.

The joining material 3 will be explained referring to FIG. 11. The joining material itself is disclosed in Japanese Patent publication 2001-76677A.

For producing the joining material 3, a glass or ceramic composition is impregnated into a porous bone structure composed of a sintered body of metal powder. The sintered body has open pores therein.

A material for the metal powder includes a pure metal such as molybdenum tungsten, rhenium, niobium, tantalum or the like, and the alloys thereof.

The ceramic composition to be impregnated into the metal sintered body may preferably be composed of components selected from the group consisting of $Al_2O_3$, $SiO_2$, $Y_2O_3$, $Dy_2O_3$, $B_2O_3$ and $MoO_3$, and most preferably composed of $Al_2O_3$. In particular, the ceramic composition may preferably composed of 60 weight percent of dysprosium oxide, 15 weight percent of alumina and 25 weight percent of silica.

Figure 11:
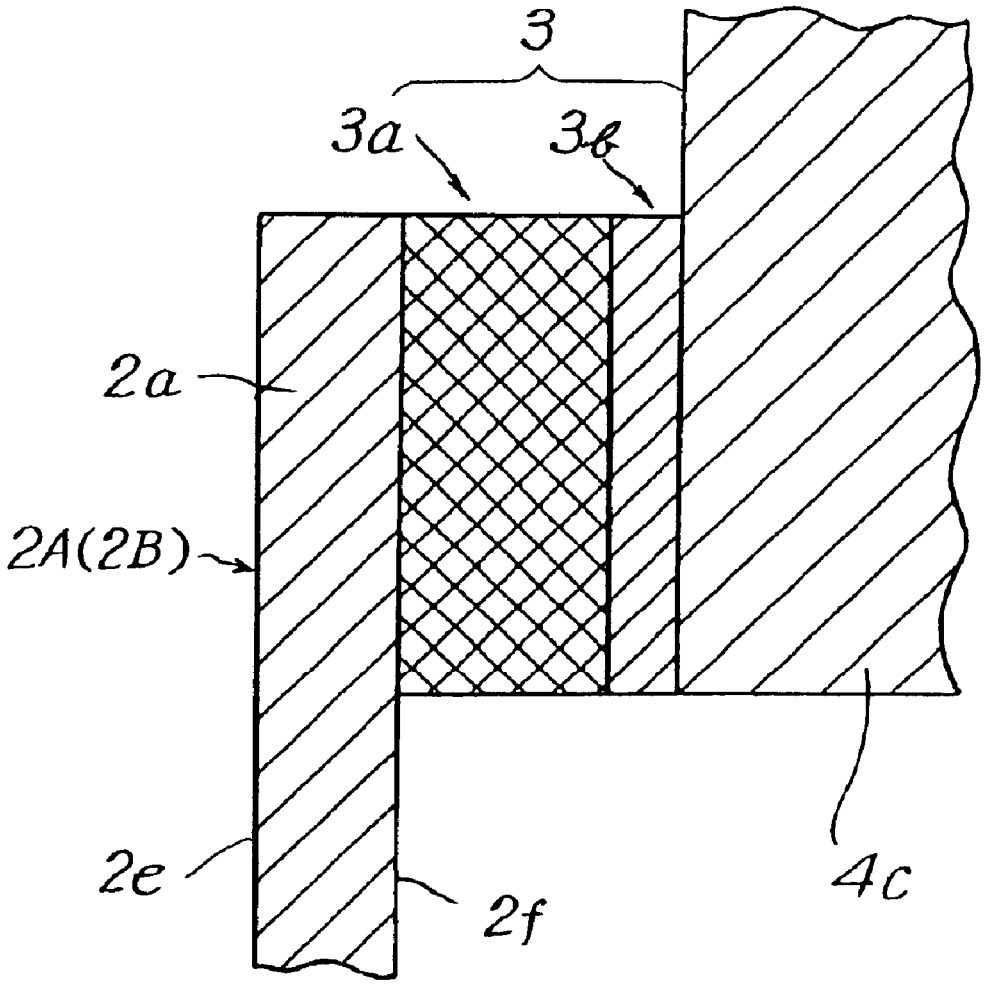
FIG. 11 is a longitudinal and enlarged sectional view showing the joining part of the light emitting vessel and an electrode supporting member, according to one example of fabrication of a discharge lamp of the invention.

After the impregnating process, as shown in FIG. 11, an impregnated ceramic composition phase 3*a* and an interfacial ceramic composition layer 3*b* are formed. In the phase 3*a*, a ceramic composition is impregnated into the open pores of the metal sintered body. The layer 3*b* has the composition described above and does not substantially include the metal sintered body.

In the embodiments described above, a high pressure discharge lamp according to the present invention has been applied for a head lamp for an automobile. The high pressure discharge lamp of the invention, however, may be applied to various kinds of lighting systems using pseudo point lighting sources, including an OHP (over head projector) and liquid crystal projector.

EXAMPLES

The high pressure discharge lamp 11 shown in FIG. 7 was produced. The light emitting vessel 12 was formed by polycrystalline alumina with a total light transmittance of 96 percent and a linear light transmittance of 3 percent. The vessel 11 has an outer diameter of 3.4 mm, an inner diameter of 1.1 mm, and a length of 11 mm. The thickness of the vessel is substantially constant. The joining material was produced by impregnating a composition of dysprosium oxide-alumina-silica system into the open pores of a porous bone structure of molybdenum. $ScI_3$—NaI gas and Xe gas were filled in the inner space of the vessel. A reflector 16 was fixed as shown in FIG. 6. Fifteen of such high pressure discharge lamps according to a comparative example were prepared. A normal input voltage was supplied to the lamp to perform lighting cycles. Each cycle has a turning-on stage for 3 minutes and a turning-off stage for 2 minutes. After 2500 hours, cracks were not found in all the tested lamps.

Then, the high pressure discharge lamps 11 of the comparative example were subjected to over load operation by supplying a voltage of 20 percent higher than the normal voltage, so that the lighting cycles were performed over 2500 hours. As a result, cracks were found in two of the fifteen lamps tested.

The high pressure discharge lamp 1A shown in FIG. 1 according to the present invention was produced. The light emitting vessel 2A was formed by polycrystalline alumina with a total light transmittance of 96 percent and a linear light transmittance of 3 percent. The vessel 2A has an outer diameter of 3.4 mm, an inner diameter of 1.1 mm and a length of 11 mm. The thickness of the thicker portion 2*g* is 1.0 mm. The minimum of the cross sectional area of the thinner portion is adjusted to 60 percent of that of the thicker portion. The joining material was produced by impregnating a composition of dysprosium oxide-alumina-silica system into the open pores of a porous bone structure made of molybdenum. $ScI_3$—NaI gas and Xe gas were filled in the inner space of the vessel. A reflector 16 was fixed as shown in FIG. 6. Fifteen of such high pressure discharge lamps according to the present invention were prepared. The lamps of the present invention were subjected to over load operation by supplying a voltage of 20 percent higher than the normal voltage, so that lighting cycles were performed. Each cycle has a turning-on stage for 3 minutes and a turning-off stage for 2 minutes. After 2500 hours, cracks were not found in all the tested lamps.

The present invention has been explained referring to the preferred embodiments. However, the present invention is not limited to the illustrated embodiments which are given by way of examples only, and may be carried out in various modes without departing from the scope of the invention.

What is claimed is:

1. A high pressure discharge lamp comprising a light emitting vessel made of a semitransparent ceramic material and having a pair of end portions each with an opening formed in said end portion and a light emitting portion, a pair of discharge electrodes, and electrode supporting members each supporting said discharge electrode and fixed to said end portion, wherein said light emitting vessel defines an inner space, an ionizable light emitting substance and a starter gas are filled in said inner space, said electrodes are contained in said inner space, said light emitting portion has a thicker wall portion and a thinner wall portion, and said thinner wall portion has a cross sectional area of not smaller than 35 percent and not larger than 80 percent of that of said thicker wall portion so that said light emitting portion has a brightness center in said thinner wall portion.

2. The lamp of claim 1, wherein said light emitting vessel has an outer diameter substantially constant in the whole length of said light emitting portion.

3. The lamp of claim 1, wherein a recess is formed on the inner surface of said thinner wall portion.

4. The lamp of claim 1, wherein said light emitting portion has a plurality of said thinner wall portions.

5. The lamp of claim 1 having dimensions so as to function as a pseudo point light source.

6. A lighting system comprising the high pressure discharge lamp of claim 1.

7. The system of claim 6, wherein said lamp may function as a pseudo point light source.

8. A head lamp for an automobile comprising the system of claim 7.

9. A light emitting vessel for a high pressure discharge lamp, said light emitting vessel being made of a semitransparent ceramic material and having a pair of end portions each with an opening formed in said end portion and a light emitting portion, wherein said light emitting vessel defines an inner space, an ionizable light emitting substance and a starter gas are filled in said inner space said light emitting portion has a thicker wall portion and a thinner wall portion, and said thinner wall portion has a cross sectional area of not smaller than 35 percent and not larger than 80 percent of that of said thicker wall portion.

10. The vessel of claim 9, comprising an outer diameter substantially constant over the whole length of said light emitting portion.

11. The vessel of claim 9, wherein a recess is formed on the inner surface of said thinner wall portion.

12. The vessel of claim 9, comprising a plurality of said thinner wall portions.

13. The vessel of claim 9, having dimensions so as to function as a pseudo point light source.

* * * * *